US008591701B2

(12) United States Patent
Sung et al.

(10) Patent No.: US 8,591,701 B2
(45) Date of Patent: Nov. 26, 2013

(54) EXTRACTION OF HEMP FIBERS

(75) Inventors: Wing L. Sung, Ottawa (CA); Mark Wood, Ottawa (CA); Fang Huang, Ottawa (CA)

(73) Assignee: National Research Council of Canada, Ottawa, Ontario (CA)

( * ) Notice: Subject to any disclaimer, the term of this patent is extended or adjusted under 35 U.S.C. 154(b) by 629 days.

(21) Appl. No.: 12/303,931

(22) PCT Filed: May 14, 2007

(86) PCT No.: PCT/CA2007/000861

§ 371 (c)(1),
(2), (4) Date: Dec. 8, 2008

(87) PCT Pub. No.: WO2007/140578

PCT Pub. Date: Dec. 13, 2007

(65) Prior Publication Data

US 2010/0147472 A1 Jun. 17, 2010

Related U.S. Application Data

(60) Provisional application No. 60/811,791, filed on Jun. 8, 2006.

(51) Int. Cl.
*D21C 7/14* (2006.01)

(52) U.S. Cl.
USPC ..... 162/49; 162/76

(58) Field of Classification Search
USPC ..... 162/49, 76
See application file for complete search history.

(56) References Cited

U.S. PATENT DOCUMENTS

| | | | | |
|---|---|---|---|---|
| 1,796,718 | A | 3/1931 | Rattonji | |
| 4,481,355 | A | 11/1984 | Jaskowski | |
| 4,617,383 | A * | 10/1986 | Jaskowski | 536/2 |
| 2004/0191888 | A1 | 9/2004 | Clarke et al. | |
| 2006/0089283 | A1 * | 4/2006 | Glad et al. | 510/320 |

FOREIGN PATENT DOCUMENTS

| | | |
|---|---|---|
| EP | 0931862 | 7/1999 |
| EP | 1780316 | 5/2007 |
| FR | 875368 | 9/1942 |
| FR | 2713671 | 6/1995 |
| GB | 1082179 | 9/1967 |

OTHER PUBLICATIONS

Office Action dated Nov. 9, 2010 in Chinese Patent Application No. 200780021113.8 and English-language translation thereof.
PCT International Search Report, Dec. 13, 2007, from corresponding PCT/CA2007/000861.

(Continued)

*Primary Examiner* — Jacob Thomas Minskey
(74) *Attorney, Agent, or Firm* — Klarquist Sparkman, LLP

(57) ABSTRACT

A method of extracting hemp fibers from decorticated hemp bast skin involves pre-treating the decorticated hemp bast skin with an aqueous solution containing di-sodium citrate, tri-sodium citrate or a mixture thereof having a pH of from about 6-13 at temperature of about 90° C. or less; and subsequently treating recovered fiber with a enzyme. Determining the extent of completion of a plant fiber degumming process involves treating degummed fiber with a recombinant pectinase expressed in an organism that produces neither cellulose nor xylanase, to release reducing sugar from any residua pectin on the degummed fiber, and, quantifying the released reducing sugar.

18 Claims, 1 Drawing Sheet

(56) References Cited

OTHER PUBLICATIONS

PCT International Preliminary Report on Patentability, Dec. 10, 2008, from corresponding PCT/CA2007/000861.
Notice of Acceptance dated Apr. 18, 2011 in corresponding Australian Patent Application No. 2007257276.
Notice of Granting Patent Right for Invention (with English-language translation), dated May 19, 2011, issued in corresponding Chinese Patent Application No. 200780021113.8.
European Supplementary Search Report, Jun. 21, 2010.
Adamsen A P S et al.: "Chelating Agents and Enzyme Retting of Flax", Textile Research Journal, Sage Publications, London, GB, vol. 72, No. 4, Apr. 1, 2002, pp. 296-302.
Zhang J et al.: "Effects of Acidic Media Pre-Incubation on Flax Enzyme Retting Efficiency", Textile Research Journal, Sage Publications, London, GB, vol. 73, No. 3, Mar. 1, 2003, pp. 263-267.

* cited by examiner

EXTRACTION OF HEMP FIBERS

CROSS-REFERENCE TO RELATED APPLICATIONS

This application claims the benefit of U.S. Provisional Patent Application Ser. No. 60/811,791 filed Jun. 8, 2006, the entire contents of which is hereby incorporated by reference.

FIELD OF THE INVENTION

The present invention is directed to processes for extracting hemp fibers.

BACKGROUND OF THE INVENTION

Historically, hemp fibers have been used in the textile industry. However, recent breakthroughs in materials science have allowed strong and renewable fibers, for example those from hemp, to replace glass fibers as reinforcement in composite materials. Development of protocols to extract hemp fibers while maintaining their integrity is an important aspect to their use in both the textile industry and in composite materials. Such protocols preferably avoid the use of hazardous and/or non-biodegradable agents.

In common fiber plants, e.g. hemp, flax and jute, a bark-like layer containing bast fibers surrounds a woody core. The bast fibers are surrounded by pectin or other gums. Decortication, either manually or mechanically, is a Process to remove the bark-like layer from the woody core.

Extraction of fiber from the decorticated bark would allow its eventual usage. Extraction primarily involves removal of pectin and colour-containing materials from the fiber (degumming). Pectin is a polysaccharide which is a polymer of galacturonic acid. Pectin is not soluble in water or acid. However, it can be removed by strong alkaline solutions like caustic soda (concentrated sodium hydroxide).

General methods for isolation of clean fibers include dew retting, water retting, and chemical and enzymatic processes, with different variations. In these methods, the glue that holds the fibers together must first be loosened (or removed altogether) by retting. In conventional retting, stalks are dew-retted by allowing them to lie in the field after cutting. In some areas of the world, hemp is water-retted by placing bundles of stalks in ponds or streams. These retting approaches depend on digestion of pectin by enzymes secreted by microbes thriving under favorable conditions. Although water-retting yields more uniform fiber, the process pollutes the water. Dew-retting requires anywhere from two to six weeks or more to complete, requiring the stalks to be turned at least once for highest-quality fiber. Dew-retting is thus affected by the weather, which offers no guaranty of favorable conditions.

On an industrial scale, chemical retting is common. It involves violent, hazardous chemicals like soda ash, caustic soda and oxalic acid. Enzyme retting involves the action of pectinase with or without other enzymes like xylanase and/or cellulase. However, the practical application of such enzymes for isolation of hemp fiber remains to be proven.

Various retting processes are known in the art. Clarke et al (2002) describes a process of removing pectin or gummy materials from decorticated bast skin to yield individual fibers by placement of the bast skin (with or without soaking in an enzyme solution in a pretreatment process) into a closed gas-impermeable container such as plastic bag. The enzyme-producing microbes natural to the bast skin, will thrive on the initial nutrients released by the enzyme pretreatment and will finish the retting process in this closed environment. Clarke et al (2002) also describes an alternative pre-treatment process involving chemicals instead of enzymes, and this includes caustic soda, soda ash, sodium silicate, oxalic acid and ethylenediaminetetraacetic acid (EDTA).

Both chemical and enzyme retting processes generally utilize common chelating agents like oxalic acid and EDTA to expedite the process. All have their problems in application and disposal on an industrial scale. Oxalic acid is classified or designated as a toxic, corrosive and hazardous material (particularly to the kidneys) by various jurisdictions (WorkSafe criteria). EDTA is very inert with no or negligible ability to biodegrade in the environment. EDTA is found in many natural waters and occurs at higher levels in wastewater effluents. EDTA has already been banned in Western European countries, in Australia and in parts of the United States of America, and many countries severely restrict or carefully control EDTA as a component in detergents or washing agents.

Thus, there is a need for a milder process for isolating hemp fibers that involves environmentally-friendly and/or biodegradable agents.

SUMMARY OF THE INVENTION

In accordance with one aspect of the invention, there is provided a method of extracting hemp fibers from decorticated hemp bast skin comprising pre-treating the decorticated hemp bast skin with an aqueous solution containing di-sodium citrate, tri-sodium citrate or a mixture thereof having a pH of from about 6-13 at a temperature of about 90° C. or less; and subsequently treating recovered fiber with a pectinase.

In accordance with another aspect of the invention, there is provided a method for determining extent of completion of a plant fiber degumming process comprising: treating degummed fiber with a pectinase to release reducing sugar from any residual pectin on the degummed fiber; and, quantifying the released reducing sugar.

In accordance with yet another aspect of the invention, there is provided a method for determining extent of completion of a plant fiber softening process comprising: providing wet processed fiber in a container that constrains the wet processed fiber laterally; placing a weight on top of the wet processed fiber; and, measuring a change in bulk size of the wet processed fiber due to compression by the weight.

An aqueous solution containing di-sodium citrate alone has a pH of about 6. An aqueous solution containing tri-sodium citrate alone has a pH of about 8. Addition of small amounts of a stronger base, e.g. sodium hydroxide, can convert di-sodium citrate to tri-sodium citrate and/or elevate the pH above 8. Caustic conditions, i.e. pH above 13, are avoided. Preferably, the pH is about 8-12. Preferably, the aqueous solution contains tri-sodium citrate.

Concentration of di- and/or tri-sodium citrate is preferably in a range of from about 0.4% (w/v) to about 1.6% (w/v), based on total volume of the aqueous solution. If desired, the pH can be elevated by addition of a stronger base. Preferably, the stronger base is an aqueous solution of sodium hydroxide having a concentration in a range of from about 0.01% (w/v) to about 0.5% (w/v) based on total volume of the aqueous solution.

Temperature of the aqueous solution is about 90° C. or less, preferably in a range of from about 45° C. to about 85° C., more preferably in a range of from about 55° C. to about 85° C., for example in a range of from about 65° C. to about 85° C. The aqueous solution is not subject to pressurization. Extraction is preferably performed for a period of time up to about 10 hours, more preferably up to about 5 hours, even more preferably in a range of from about 1 hour to about 5 hours. The aqueous solution may be stirred or agitated to facilitate extraction.

If desired, pre-treatment of the fibers may occur in more than one stage, a first stage in which the fibers are treated with di-sodium citrate and/or tri-sodium citrate without the addition of a stronger base, followed by one or more further stages in which the fibers are treated with tri-sodium citrate with the addition of a stronger base (e.g. sodium hydroxide, potassium hydroxide, etc.) to adjust the pH, preferably to a pH in a range of from 10-13. Concentrations of the tri-sodium citrate and the stronger base in the further stages are as described above. Temperature and time conditions of the further stages are as described above. Advantageously, the first stage increases extraction efficiency of further stages. If desired, the fibers may be washed with water between stages.

Pre-treatment as described above, whether done in one stage or more than one stage, is advantageously performed without the presence of enzymes, for example without pectinases. As a result of pre-treatment with di-sodium citrate and/or tri-sodium citrate, subsequent enzymatic treatment with pectinase is more efficient and/or may be performed under milder conditions. Advantageously, pre-treatment as described herein permits practical, industrially applicable enzymatic treatment of hemp fibers under mild, environmentally friendly conditions.

Hemp fibers recovered from pre-treatment are preferably rinsed with water before enzymatic treatment with pectinase. Enzymatic treatment of recovered hemp fibers employs one or more pectinases, preferably from fungal or bacterial sources. Preferably, enzymatic treatment is performed in an aqueous medium at a pH of from about 4-6. More preferably, the pH is from about 4.5-5. Preferably, the temperature at which enzymatic treatment is performed is in a range of from about 30° C. to 45° C., more preferably in a range of from about 40° C. to 45° C. Preferably, the aqueous medium contains salts and/or buffers, for example monosodium citrate. Concentration of any salts or buffers should not be too high as to unduly affect activity of the enzyme. For example, the concentration of monosodium citrate may be in a range of about 3-7 mM, e.g. 5 mM.

Preferably, enzymatic treatment of the fibers is performed for a period of time in a range of from about 0.5-36 hours, more preferably from about 0.5-6 hours, for example from about 1-5 hours or from about 0.5-4 hours or from about 1-3 hours. Stirring or agitation of the aqueous medium may be done. Preferably, the aqueous medium is stirred or agitated constantly during enzymatic treatment. Purified fiber after enzymatic treatment may be rinsed with water.

Purified fiber may be subjected to other treatments, for example bleaching, dyeing, etc., for its eventual application.

Advantageously, pre-treatment with di-sodium citrate and/or tri-sodium citrate permits effective extraction of hemp fiber under mild conditions using environmentally-friendly agents. Further, enzymatic treatment of fibers recovered from pre-treatment with di-sodium citrate and/or tri-sodium citrate advantageously increases efficiency of pectin removal during the subsequent enzymatic treatment. Furthermore, pre-treatment of hemp fibers with di-sodium citrate and/or tri-sodium citrate advantageously permits the use of milder enzymatic treatment conditions, thereby permitting recycling of enzymes in the extraction of the fibers. For example, used enzyme solutions can be reused for other batches of fiber up to 4 times, or even more in some cases.

Further, sodium citrates, which have been widely used in detergent and cleaners, are non-toxic, non-carcinogenic, non-bioaccumulative, non-hazardous (according to WorkSafe classification) and highly biodegradable. According to Seventeenth Report of the Joint FAO/WHO Expert Committee on Food Additives, *World Health Organisation Technical Report Ser.,* 1974, No. 539*; FAO Nutrition Meetings Report Series,* 1974, No. 53., citric acid and citrates occur in many foods and are normal metabolites of carbohydrates in all living organisms (Gruber & Halbeisen, 1948).

Citrate is the starting point of the tricarboxylic acid cycle, also known as the Citric Acid Cycle or Krebs Cycle. This cycle is a series of chemical reactions occurring in rhe cells of plants, animals and micro-organisms. Sodium citrate in doses of up to 4 g has been extensively used in medical practice for many years without giving rise to ill effects. Sodium citrates are rapidly and ultimately biodegradable under aerobic and anoxic conditions. For example, sodium citrate attained 90% ThOD (Theoretical Oxygen Demand) in a closed bottle test for ready biodegradability during 30 days.

In contrast, EDTA (though non-toxic) is inert in the environment and banned in various regions for washing purposes. Oxalic acid is classified as a "hazardous and toxic" substance.

Since pectin plays a major role in gluing hemp fibers together, estimation of residual pectin in treated fiber helps to determine the extent of completion of the degumming process, and hence the quality of fiber. Enzyme hydrolysis is a specific reaction, as compared to other chemical processes, which can break down other polysaccharides than pectin. For determination of the removal of pectin from fiber, the enzyme pectinase can be used to hydrolyse any residual pectin from treated fiber. Quantification of the released sugars will indicate the amount of residual pectin on the fiber.

For such quantification, the use of a commercial pectinase from a culture broth of common fungi like *Aspergillus* can be complicated by co-production of other indigenous polysaccharide-hydrolysing enzymes like cellulases and xylanases during the fermentation process. Such concern of contaminating enzymes can be reduced by using a recombinant pectinase expressed in an organism, for example *E. coli*, which produces neither cellulase nor xylanase.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Example 1

Extraction of Fiber from Decorticated Bast Skin of Canadian Hemp

Figure 1:
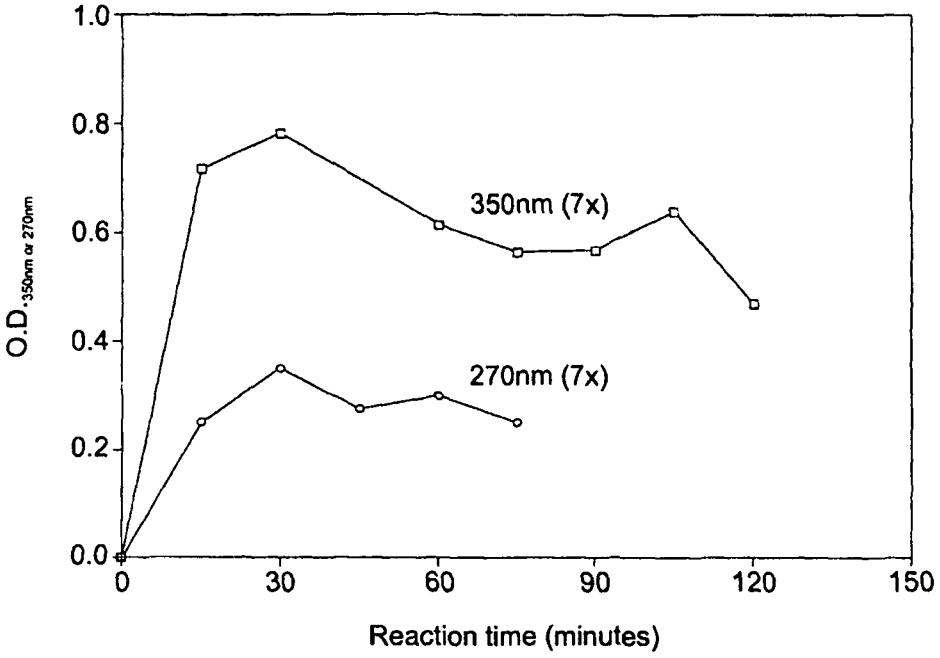
FIG. 1 is a graph of optical density (O.D.) determined at 350 nm or 270 nm as a function of reaction time (minutes) for the release of materials into solution during extraction of Canadian hemp TAB fibers by a process of the present invention; and, FIG. 2 is a graph of optical density (O.D.) determined at 350 nm or 270 nm as a function of reaction time (minutes) for the release of materials into solution during extraction of Chinese hemp fibers by a process of the present invention.

Ten grams of decorticated hemp bast skin of Canadian hemp TAB was pre-treated by agitation in 200 ml of an aqueous solution containing 0.8% (w/v) of tri-sodium citrate at 85° C. for 3 hr. Release of material into solution was monitored via optical density (O.D.) measured by UV-Vis spectroscopy at 270 nm and 350 nm (FIG. 1). The dilution factor to yield the appropriate O.D. is shown in parenthesis in FIG. 1. Pre-treated fiber was then rinsed twice with water.

Recovered fiber was treated in 200 ml of an aqueous solution containing the enzyme pectinase (Novozyme Pectinase Ultra SP-L, 1040 U) and 5 mM sodium citrate, with pH around 4.5, at 45° C. After 1 hr, the enzyme solution was recovered for recycling. The fiber was rinsed twice. The fiber has a beige color ready to be separated into finer fiber.

Example 2

Extraction of Fiber from Decorticated Bast Skin of Chinese Hemp

Soaking: Ten grams of decorticated hemp bast skin was soaked in 200 ml of water at 80° C. for 30 min.

Step 1: The fiber was then agitated in 200 ml of a solution containing 0.8% (w/v) of tri-sodium citrate at 80° C. for 1 hr. Treated fiber was rinsed twice with tap water.

Step 2: Step 1 was followed by agitation in 200 ml of an aqueous solution containing 0.8% (w/v) of tri-sodium citrate and 0.2% (w/v) of NaOH at 80° C. for 1.5 hr. Treated fiber was rinsed twice with water.

Figure 2:
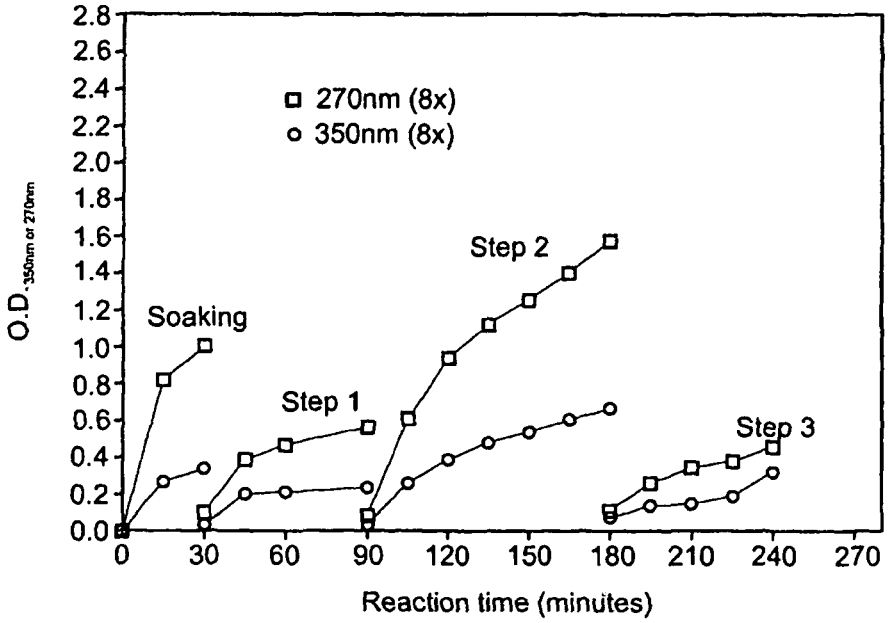

Step 3: Recovered fiber was treated in 200 ml of a solution containing the enzyme pectinase (Novozyme Pectinase Ultra SP-L, 1040 U) and 5 mM sodium citrate, with pH around 4.5, at 45° C. After 1 hr, the enzyme solution was recovered for recycling. The fiber was rinsed twice. The fiber was ready to be separated into finer fiber. Release of materials into each of the solutions was monitored via O.D. measured by UV-Vis spectroscopy at 270 nm and 350 nm (FIG. 2). The dilution factor to yield the appropriate O.D. is shown in parenthesis in FIG. 2.

Example 3

Softening of Hemp Fiber

After enzymatic treatment from Examples 1 and 2, wet hemp fiber (5 g) was washed with 120 ml of isopropanol for 5 min to produce a colored isopropanol solution. The colored isopropanol solution was decanted, and the fiber was allowed to air-dry. The fiber is softer than those without the isopropanol treatment.

Example 4

Preparation of Recombinant Polygalacturonase of *Erwinia carotovora* Expressed in *E. coli*

The production of a recombinant pectinase, i.e. polygalacturonase of *Erwinia carotovora*, has been accomplished via (i) isolation of the pectinase gene from *Erwinia carotovora* via PCR, (ii) cloning into a linearized plasmid pTrX, and (iii) expression of the said gene in *Escherichia coli*. The precursor plasmid pTrX for gene cloning has previously been published (Sung et al., U.S. Pat. No. 5,759,840 issued Jun. 2, 1998 to Sung et al., the disclosure of which is herein incorporated by reference). It contains a functional *Trichoderma reesei* xylanase gene and therefore can express the enzyme xylanase.

PCR was used to generate a DNA fragment encoding both the secretion leader and the mature pectinase with the PCR primers Ecp-N1a and Ecp-C1a in the construction of plasmid pEcp3a.

```
Ecp-N1a
                    1   2   3   4   5   6   7   8
secretion leader E   Y   Q   S   G   K   R   V
 5'-TT GCT AGC GAA TAT CAA TCA GGC AAG CGA GTT TTA TC
        NheI

Ecp-C1a
                   379 378 377 376 375 374 373 372 371 370
              stop   K   K   V   T   V   N   K   I   Q   W
5'-AA AGA TCT TTA CTT CTT AAC GGT GAC GTT CTT GAT TTG CCA
       Bgl II

SEQ ID NO: 1 = EYQSGKRV

SEQ ID NO: 2 = TT GCT AGC GAA TAT CAA TCA GGC AAG CGA GTT TTA TC

SEQ ID NO: 3 = KKVTVNKIQW

SEQ ID NO: 4 = AA AGA TCT TTA CTT CTT AAC GGT GAC GTT CTT GAT TTG CCA
```

The PCR template is the DNA of the bacterium *Erwinia carotovora* which was directly liberated under normal PCR protocol. With the primers Ecp-N1a, a PCR product of 1100 bp was prepared. This product was cut by the restriction nucleases NheI and BglII, and was ligated into a NheI/BglII-linearized plasmid pTrX to generate new plasmid pEcp3a.

Subsequent cloning steps involved (i) transformation into the *E. coli* HB101 competent cells followed by spreading on YT plate (containing 5 g yeast extract, 3 g bacto-tryptone, 5 g NaCl, 15 g of agar in 1 L of water, 1 g Remazol Brilliant Blue R-D-xylan) and ampicillin (100 mg/L), (ii) identification of the pectinase transformants containing the new plasmid pEcp3a, through the loss of xylanase activity (absence of a clearing zone or halo around the colonies on the blue xylan plate overnight at 40° C.), and (iii) confirmation of the successful cloning through dideoxy nucleotide sequencing of the isolated plasmid pEcp3a.

The production of the recombinant pectinase was accomplished via culture of the *E. coli* transformants with plasmid pEcp3a. The culture conditions comprised a 5 ml culture of overnight innoculant in 2YT medium (16 g bacto-tryptone, 10 g yeast extract, 5 g NaCl, 1 L of water) containing ampicillin (100 mg/L). It was spread out on an tray (32×25 cm) evenly covered by 0.5 L of solidified YT agar (8 g yeast extract, 5 g bacto-tryptone, 5 g NaCl, 15 g of agar in 1 L of water) containing ampicillin (100 mg/L). The cultures were grown at 37° C. After 40 hr, cells (2 g) were harvested for extraction of pectinase.

The harvested cells were put into a tube for a freeze-thaw extraction of pectinase. The procedure comprised a freezing period in a dry ice/ethanol bath for 5 min, followed by water/ice bath for 10 min. The procedure was repeated thrice. The cells were extracted with buffer (5 mal, 100 mM Na citrate, pH 5.5). Centrifuging at 8000×g for 30 min yielded a supernatant containing pectinase that can directly be used for the analytical assay in Example 5.

Example 5

Analysis of Residual Pectin in Treated Fiber

Extent of removal of pectin from hemp fiber was determined via measurement of the quantity of reducing sugar generated by the specific hydrolysis of residual pectin on the treated fiber by a pectinase.

C1 is a comparative sample of untreated hemp. C2 is a comparative sample of hemp processed with 7% (w/v) NaOH at 90° C., the processing resulting in fiber damage. C3 is a comparative sample of commercially available chemically processed hemp obtained from Aurorasilk Com. (Portland, Oreg., U.S.A.). S1 is a sample of hemp processed in accordance with Example 2.

Commercial processes such as those used to produce the sample C3 generally involve the use of high pressure (e.g. 80 lbs per square inch), high temperature (e.g. 160° C.) and high concentration of sodium hydroxide (e.g. 6% (w/v)).

One of the pectinases used was the recombinant polygalacturonase of *Erwinia carotovora* expressed in *E. coli* as prepared in Example 4. The other pectinase used was Novozyme Pectinase (polygalacturonase) from *Aspergillus niger*. The following general method was used.

A reaction mixture containing 30 mg of treated fiber and 1 U of recombinant pectinase or 20 μl diluted Novozyme Pectinase (50× dilution) in 400 μl of a buffer (100 mM sodium citrate, pH 5.0 for recombinant pectinase, pH 4.5 for Novozyme Pectinase), was heated at 40° C. After 1 hr, 50 μl of the reaction solution was removed and was added into 1 ml of 10 mM NaOH to stop further hydrolysis. The amount of reducing sugar was determined with a well-established method involving the hydroxylbenzoic acid hydrazide reagent (HBAH) (Lever, 1972 *Analytical Biochem* 47:273-279, the disclosure of which is herein incorporated by reference). After HBAH treatment, the solution turned yellow. The quantity of reducing sugar can be determined though the reading of O.D. at 420 nm, and read against a standard curve with O.D. versus known quantities of galacturonic acid. Table 1 provides results.

It is evident from Table 1 that an extraction process of the present invention is effective at degumming hemp fiber. According to analysis by the recombinant bacterial *Erwinia carotovora* pectinase, the process of Example 2 as represented by Sample S1 was not as effective as the commercial process (C3) or the process using 7% NaOH(C2), but the conditions in C2 and C3 were much harsher and less environmentally friendly. However, alternative analysis by the fungal *Aspergillus niger* pectinase indicated the reverse order of effectiveness, with S1 possessing less residual pectin than C3. Although slightly different results were obtained from the two analytical tests, both tests generally showed S1 having most of the pectin removed by the process of Example 2 as compared to untreated hemp. This example demonstrates the effectiveness of pectinase-based analysis for determining residual pectin.

Example 6

Method for Monitoring the Softness of the Fiber Mass

Softness of the fiber is a premium quality of the processed fiber, in addition to its brightness and separateness. An efficient method for monitoring the gradual softening of the fiber from a rigid crude mass during the course of treatment is useful for the development of the optimal processing technology.

A monitoring method, called the "Drop Test", has been established based on the ability of rigid and non-separated fiber strands to stand up to a certain weight added on the top. During the treatment process, the loss of rigidity due to the softening or separation of the wet processed fiber mass will decrease its resistance to stand up to the set weight. This gradual loss of resistance to the set weight can be determined by measuring the decreasing space occupied by the fiber mass in a graduated cylinder. The space occupied by the treated fiber mass is a combination of its swollen bulk and air space caused by the rigidity of the bulk itself.

To this end, wet processed fiber mass, which has already been drained of solution, was placed in a glass graduated cylinder. A weight in form of a Teflon™ puck was gently dropped on top of it. Against the marking of the graduated cylinder, the volume or space occupied by the fiber mass was determined. Such measurement was repeated thrice, and the mean of the 3 measurements was accepted. As the treatment progressed, the degummed fiber mass softened, it started to lose its rigidity to stand up against the puck, thus gradually occupying lesser space in the cylinder.

TABLE 1

| Sample | Release of reducing sugar from residual pectin ($OD_{420}$), by recombinant pectinase of *Erwinia carotovora*, overnight | Release of reducing sugar from residual pectin ($OD_{420}$), by Novozyme Pectinase (polygalacturonase) from *Aspergillus niger* |
|---|---|---|
| C1 | 2.350 | 1.353 |
| C2 | 0.154 | 0.168 |
| C3 | 0.169 | 0.334 |
| S1 | 0.342 | 0.215 |

Example 7

"Drop Test" for Monitoring Canadian Hemp Fiber Processed Via Variations of the 2-Step Protocol of Example 1

Five samples of Canadian hemp fiber were processed via five protocols as outlined in Table 2. S2 represents samples processed in accordance with the present invention. Major variations in the protocol from Example 1 are indicated in parenthesis. The general conditions of Example 1 are indicated in the last row of Table 2 as reference.

TABLE 2

| Sample | Step 1 | Step 2* |
|---|---|---|
| S2 | Tri-sodium citrate, 55° C., 5 hr (55° C., 5 hr) | Pectinase Ultra, sodium citrate buffer, 45° C. |
| C4 | Tri-sodium citrate, 55° C., 5 hr (55° C., 5 hr) | Sodium citrate buffer, 45° C. (without pectinase) |
| C5 | Water, 55° C., 5 hr (without tri-sodium citrate; 55° C., 5 hr) | Water, 45° C. (without pectinase, or sodium citrate buffer) |
| C6 | Water, 55° C., 5 hr (without tri-sodium citrate; 55° C., 5 hr) | Sodium citrate buffer, 45° C. (without pectinase) |
| C7 | Bypassing Step 1 | Pectinase Ultra, sodium citrate buffer, 45° C. |
| Example 1 | Tri-sodium citrate, 85° C., 3 hr | Pectinase Ultra, sodium citrate buffer, 45° C., 1 hr |

*Step 2 was allowed to proceed to show the effect of pectinase on the fiber. The fiber samples were monitored with the "Drop Test" at 2, 4, 6, 24, 30 and 48 hr.

For monitoring the processing of 3 g of decorticated Canadian hemp fiber, a standard 250-ml graduated cylinder with a height of 32 cm, an inner diameter of 3.8 cm and markings for 2 ml was used. A circular Teflon™ puck having an outer diameter of 3.6 cm, a height of 2 cm, a weight of 22 g and three holes of diameter of 0.4 cm drilled vertically in the center, was placed gently into the cylinder to slide onto the top of the fiber mass. A reading of the space occupied by the fiber mass (bulkiness) was made based on the bottom of the puck against the marking on the cylinder.

As the treatment progressed, the fiber started to lose its rigidity and was less able to stand up against the Teflon™ puck. The whole mass became less bulky and softer, thus occupying less space under the weight of the same puck (Table 3).

After Step 1, based on the bulkiness of the processed fibers, it was obvious that samples S2 and C4 treated with tri-sodium citrate in Step 1, had smaller bulk or occupied less space, as compared to C5 and C6 that were processed with water only (44 ml and 48 ml versus 69 ml and 72 ml). Visually S2 and C4 were lighter in color compared to C5 and C6. This confirms the beneficial role of tri-sodium citrate in softening and brightening the fiber. The tri-sodium citrate treatment in Step 1 also enhanced the effect of the subsequent enzymatic Step 2 as indicated below.

TABLE 3

| | Bulk Size (ml) | Bulk Size (ml) Step 2 | | | | | |
|---|---|---|---|---|---|---|---|
| Sample | Step 1 | 2 hr | 4 hr | 6 hr | 24 hr | 30 hr | 48 hr |
| S2 | 44 | 40 | 40 | 34 | 32 | 28 | 27 |
| C4 | 48 | 47 | 48 | 39 | 41 | 38 | 39 |
| C5 | 69 | 66 | 64 | 62 | 64 | 64 | 62 |
| C6 | 72 | 72 | 57 | 62 | 65 | 61 | 66 |
| C7 | — | 75 | 64 | 57 | 46 | 46 | 45 |

During Step 2, sample S2 treated with pectinase continued with a greater decrease in bulk over time (12 ml in 24 hr) (Table 3), as compared to C4 (7 ml in 24 hr), which was subjected to sodium citrate buffer without the enzyme.

During Step 2 both samples C5 and C6 treated without pectinase and previously processed with only water in Step 1 showed comparatively smaller decrease in bulk with time (5 ml in C5 vs. 7 ml in C6, after 24 hr) (Table 3). However, visually C6 was brighter than C5, with the former subject to sodium citrate buffer and the latter in water only.

Sample C7, which has bypassed the Step 1 of tri-sodium citrate treatment and relied solely on the pectinase treatment of Step 2 showed a steady decrease in bulk with time (Table 3), contrary to C4, C5 and C6. This confirmed the essential role of pectinase in softening the fiber. However, C7 remained bulkier than S2 after 24 hr (46 ml vs. 32 ml) and 48 hr (45 ml vs. 27 ml) with the size of the bulk not reducing further, unlike sample S2. Furthermore, the processed C7 is visually darker than S2. These differences between S2 and C7 demonstrate the crucial role in Step 1 of tri-sodium citrate for enhancing the subsequent pectinase treatment step in the processing of hemp fiber.

Determination of the Simple Sugars Released During Step 2

The simple sugars released with or without Pectinase Ultra in Step 2 were determined in order to demonstrate the effect of the variations in Steps 1 and 2 outlined in Table 2. The procedure for quantification of released sugar was identical to that described in Example 5. To this end, 50 μl of the reaction supernatant was removed and added into 1 ml of 10 mM NaOH to stop further hydrolysis. The amount of reducing sugar was determined with a well-established method involving the hydroxylbenzoic acid hydrazide reagent (HBAH) (Lever, 1972 *Analytical Biochem* 47:273-279, the disclosure of which is herein incorporated by reference). After HBAH treatment, the solution turned yellow. The quantity of reducing sugar can be determined though the reading of O.D. at 420 nm as indicated in Table 4.

TABLE 4

| | Release of reducing sugars ($OD_{420}$) during step 2 | | | | | |
|---|---|---|---|---|---|---|
| Sample | 2 hr | 4 hr | 6 hr | 24 hr | 30 hr | 48 hr |
| S2 | 0.945 | 1.279 | 1.501 | 2.134 | 2.445 | 2.789 |
| C4 | 0.046 | 0.110 | 0.132 | 0.189 | 0.206 | 0.266 |
| C5 | 0.010 | 0.014 | 0.018 | 0.025 | 0.029 | 0.041 |
| C6 | 0.045 | 0.079 | 0.094 | 0.163 | 0.184 | 0.202 |
| C7 | 1.078 | 1.558 | 1.904 | 2.835 | 2.930 | 3.280 |

Of five samples (Table 4), only S2 and C7 with pectinase in Step 2 released significant amount of reducing sugars into the supernatants. Among the remaining three samples without pectinase in Step 2, sample C5 released little or no reducing sugar in the process, Analysis of Residual Pectin Retained in Processed Canadian Hemp Fiber In addition to the "Drop Test" to check the rigidity or softness of the fiber, the extent of degumming in samples S2, C4, C5, C6 and C7 was also investigated. To this end, the residual pectin remaining in the fiber samples was determined via the enzymatic analysis which has already been described in Example 5. For comparison, C3, the commercially available chemically processed hemp obtained from Aurorasilk Com. (Portland, Oreg., U.S.A), was used as a reference. The Novozyme Pectinase (polygalacturonase) from *Aspergillus*

*niger*, was used to release the reducing sugar from any residual pectin on the samples. The reducing sugar released from the different fiber samples was determined at 2 hr, 5 hr and 24 hr (Table 5).

TABLE 5

| Processed sample | Release of reducing sugar from residual pectin ($OD_{420}$) of the processed fiber samples, by Novozyme Pectinase (polygalacturonase) from *Aspergillus niger* | | |
|---|---|---|---|
| | 2 hr | 5 hr | 24 hr |
| S2 | 0.121 | 0.208 | 0.537 |
| C4 | 0.408 | 0.979 | 2.756 |
| C5 | 0.338 | 0.590 | 2.093 |
| C6 | 0.582 | 1.589 | 5.196 |
| C7 | 0.387 | 0.813 | 2.954 |
| C3 | 0.207 | 0.317 | 0.548 |

In the enzymatic analysis (Table 5), sample S2 which was treated with tri-sodium citrate in Step 1 and Pectinase Ultra in Step 2, has very little reducing sugar released by the pectinase at 2 hr, 5 hr and 24 hr. This indicates that it has only retained very little residual pectin, comparable to sample C3, the commercially available chemically processed hemp (0.537 OD versus 0.548 OD respectively at 24 hr).

The other samples C4, C5, C6 and C7, which have not been treated with tri-sodium citrate in Step 1 or pectinase in Step 2, retained significant amount of pectin (2.756, 2.093, 5.196 and 2.954 OD respectively at 24 hr). In sample C7 which bypassed Step 1, the sole treatment with pectinase in Step 2 failed to remove most of the pectin. As a result, a significant amount of residual pectin remained in the processed fiber C7 (Table 5).

Although the processed sample C5 was the most bulky in the Drop Test (Table 3) and demonstrated the least release of simple sugar into the supernatant during Step 2 (Table 4), it released a relatively small amount of reducing sugar in the residual pectin analysis (0.590 OD at 5 hr, Table 5) compared to C4, C6 and C7. This suggests that most of the pectin remained embedded in the processed sample C5.

The existence of embedded pectin in C5 was confirmed when the already processed sample (C5) was subjected to another round of more rigorous processing, involving a Step 1 with tri-sodium citrate (55° C., 5 hr), and a Step 2 with Pectinase Ultra (sodium citrate buffer, 45° C.), both steps involving sodium citrate versus water only in the original design in Table 2. An analysis of the supernatant in the new Step 2, showed a large release of simple sugars from the re-processed C5, with OD of 1.221 and 1.967 after 2 and 6 hr, respectively. This release of reducing sugar waste by the re-processed sample C5 was comparable to that of sample S2 in Table 4, thereby confirming the role of tri-sodium citrate in the degumming process.

Example 8

"Drop Test" for Monitoring Chinese Hemp Fiber Processed Via Variations of the 3-Step Protocol of Example 2

For the processing of 6 g crude Chinese decorticated hemp fiber, a standard 500-ml graduated cylinder with a height of 32 cm, an inner diameter of 5.3 cm and markings for 5 ml was used. A circular Teflon™ puck having an outer diameter of 4.8 cm, a height of 2 cm, a weight of 55 g and three holes of diameter of 0.4 cm drilled vertically in the center was placed on top of the processed fiber to get an accurate reading of the bulk of the mass against the cylinder.

Four samples of Chinese hemp fiber were processed via four protocols as outlined in Table 6. Major variations in the protocol from Example 2 are indicated in parenthesis. The general conditions of Example 2 are indicated in the last row of Table 6 as reference.

TABLE 6

| Sample | Step 1 | Step 2 | Step 3* |
|---|---|---|---|
| S3 | Tri-sodium citrate, 80° C., 1 hr | NaOH, tri-sodium citrate, 80° C., 1.5 hr | Pectinase Ultra, sodium citrate buffer, 45° C. |
| S4 | Tri-sodium citrate, 80° C., 1 hr | NaOH, tri-sodium citrate, 80° C., 4 hr (4 hr) | Same |
| C8 | Water, 80° C., 1 hr (without tri-sodium citrate) | NaOH, water, 80° C., 1.5 hr (without tri-sodium citrate) | Same |
| C9 | Water, 80° C., 1 hr (without tri-sodium citrate) | NaOH, water, 80° C., 4 hr (without tri-sodium citrate; 4 hr) | Same |
| Example 2 | Tri-sodium citrate, 80° C., 1 hr | NaOH, tri-sodium citrate, 80° C., 1.5 hr | Pectinase Ultra, sodium citrate buffer, 45° C., 1 hr |

*Step 3 was allowed to proceed to show the effect of pectinase on the fiber. The fiber samples were monitored with the "Drop Test" at 1, 3, 4 and-5 hr.

In summary, samples S3 and S4 were treated with tri-sodium citrate in Steps 1 and 2 in accordance with the present invention. The only difference between S3 and S4 was that the time of Step 2 involving NaOH was extended from 1.5 hr for S3 to 4 hr for S4 (Table 6). The conditions for samples C8 and C9 were identical to those of S3 and S4, except that tri-sodium citrate was absent in both Steps 1 and 2. All 4 samples were eventually treated with pectinase in Step 3.

As the treatment progressed, the fiber started to lose its rigidity and was less able to stand up against the Teflon™ puck. The whole mass became less bulky and softer, thus occupying less space under the weight of the same puck (Table 7). The fiber mass from Step 1 was measured with the 500-ml graduated cylinder as indicated above. In Steps 2 and 3, the fiber mass was measured with the smaller 250-ml cylinder and the smaller puck described in Example 7.

TABLE 7

| Sample | Bulk Size (ml) Step 1 | Bulk Size (ml) Step 2 | Bulk Size (ml) Step 3 | | | |
|---|---|---|---|---|---|---|
| | | | 1 hr | 3 hr | 4 hr | 5 hr |
| S3 | 145 | 46 | 43 | 40 | 41 | 38 |
| S4 | 150 | 42 | 40 | 39 | 38 | 38 |
| C8 | 145 | 60 | 58 | 56 | 48 | 48 |
| C9 | 175 | 49 | 52 | 50 | 42 | 40 |

After Step 1, the four samples remained very rigid and bulky (145-175 ml) (Table 7).

In Step 2 involving sodium hydroxide, S3 and S4 with tri-sodium citrate added in the process had a smaller bulk (46 ml and 42 ml, respectively) (Table 7), as compared to C8 and C9 without the tri-sodium citrate (60 ml and 49 ml, respectively), thus generally confirming the beneficial role of tri-sodium citrate in softening the fiber in the process. The length of treatment (1.5 hr for S3 and C8 versus 4 hr for S4 and C9) also affected the decrease of the bulk in Step 2.

In the pectinase Step 3, samples S3 and S4 which were subject to tri-sodium citrate in Steps 1 and 2, retained a smaller bulk with time (Table 7), as compared to C8 and C9. As an example, after 5 hr with pectinase, the bulks of sample S3 and S4 were 38 ml and 38 ml, versus 48 ml and 40 ml for C8 and C9, respectively. This shows that initial treatment with tri-sodium citrate in Steps 1 and 2 enhance the softening effect on the fiber by pectinase in Step 3.

Analysis of Residual Pectin in Processed Chinese-Fiber

In addition to the "Drop Test" to check the rigidity or softness of the fiber, the extent of degumming in samples S3, S4, C8 and C9 was also investigated. The residual pectin remaining on the fiber samples was determined via the enzymatic process which has already been described in Examples 5 and 7. For comparison, C3, the commercially available chemically processed hemp obtained from Aurorasilk Corn. (Portland, Oreg., U.S.A), was used. The reducing sugar released from the different fiber samples was determined at 2 hr, 5 hr and 24 hr (Table 8).

TABLE 8

| Processed | Release of reducing sugar from residual pectin ($OD_{420}$) of the processed fiber samples, by Novozyme Pectinase (polygalacturonase) from *Aspergillus niger* | | |
|---|---|---|---|
| sample | 2 hr | 5 hr | 24 hr |
| S3 | 0.080 | 0.112 | 0.335 |
| S4 | 0.073 | 0.105 | 0.363 |
| C8 | 0.084 | 0.125 | 0.439 |
| C9 | 0.064 | 0.090 | 0.270 |
| C3 | 0.220 | 0.302 | 0.575 |

In the enzymatic analysis (Table 8), all four samples have a smaller amount of reducing sugar released by the pectinase at 2 hr, 5 hr and 24 hr than the reference sample C3, the commercially chemically processed hemp. This indicates that the four samples have retained very little residual pectin, thus all were successfully degummed. Although all four processed samples lost most of their pectin (Table 8), samples S3 and S4 were judged softer or less rigid than C8 and C9, based on the Drop Test (Table 7).

REFERENCES

Jaskowski, M. C., U.S. Pat. No. 4,481,355 issued on Nov. 6, 1984.

Jaskowski, M. C., U.S. Pat. No. 4,568,739 issued on Feb. 4, 1986.

Jaskowski, M. C., U.S. Pat. No. 4,617,383 issued on Oct. 14, 1986.

Raimann, W., U.S. Pat. No. 5,510,055 issued on Apr. 23, 1996.

Sung, W. L., Yaguchi, M. and Ishikawa, K. U.S. Pat. No. 5,759,840 issued on Jun. 2, 1998.

Kling, A. and Specht, V., U.S. Pat. No. 3,954,401 issued on May 4, 1976.

Chiyouzou, H. Espacenet patent abstract of JP 55026267 published on Feb. 25, 1980.

Clarke, A. F., Dennis, H. G. S, Wang, X. and Jurren, C. J.; PCT international application PCT/AU20/00931, published on 10 Jul. 2002.

Adamsen, A. P. S., Akin, D. E. and Rigsby, L. L. (2002) *Textile Res. J.* 72:789-794.

Zhang, J., Johansson, G., Petterson, B., Akin, D. E., Foulk, J. A., Khalili, S. and Henriksson. G. (2003) *Textile Res. J.* 73:263-267.

Adamsen, A. P. S., Akin, D. E. and Rigsby, L. L. (2002) *Textile Res. J.* 72:296-302.

Lever (1972) *Analytical Biochem* 47:273-279.

Singh, D. P., Report of the Central Research Institute for Jute & Allied Fibres, Indian Council of Agricultural Research entitled "Ramie (*Boemmeria nivea*)". Section entitled "Degumming". Extracted from the Internet May, 2006.

Ouajai, S. and Shanks, R. A. (2005) *Macromol. Biosci.* 5:124-134.

Zhang, J. (2006) Doctoral Thesis Dissertation entitled "Biochemical Study and Technical Applications of Fungal Pectinase". Digital Comprehensive Summaries of Uppsala Dissertations from the Faculty of Science and Technology 137.

Other advantages that are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

SEQUENCE LISTING

```
<160> NUMBER OF SEQ ID NOS: 4

<210> SEQ ID NO 1
<211> LENGTH: 8
<212> TYPE: PRT
<213> ORGANISM: Erwinia carotovora

<400> SEQUENCE: 1

Glu Tyr Gln Ser Gly Lys Arg Val
1               5


<210> SEQ ID NO 2
<211> LENGTH: 37
<212> TYPE: DNA
<213> ORGANISM: Artificial Sequence
<220> FEATURE:
<223> OTHER INFORMATION: Primer

<400> SEQUENCE: 2

ttgctagcga atatcaatca ggcaagcgag ttttatc                    37
```

```
<210> SEQ ID NO 3
<211> LENGTH: 10
<212> TYPE: PRT
<213> ORGANISM: Erwinia carotovora

<400> SEQUENCE: 3

Lys Lys Val Thr Val Asn Lys Ile Gln Trp
1               5                   10


<210> SEQ ID NO 4
<211> LENGTH: 41
<212> TYPE: DNA
<213> ORGANISM: Artificial Sequence
<220> FEATURE:
<223> OTHER INFORMATION: Primer

<400> SEQUENCE: 4

aaagatcttt acttcttaac ggtgacgttc ttgatttgcc a                        41
```

The invention claimed is:

1. A method for extracting hemp fibers from decorticated hemp bast skin, comprising:

pre-treating the decorticated hemp bast skin with an aqueous solution containing di-sodium citrate, tri-sodium citrate, or a mixture thereof, having a pH of from about 6-13 and at a temperature of about 90° C. or less, and containing substantially no enzyme; and subsequently treating fiber, recovered from the pre-treatment, with a pectinase.

2. The method of claim 1, wherein the aqueous solution contains tri-sodium citrate.

3. The method of claim 1, wherein the pH is in a range of 8-12.

4. The method of claim 1, wherein the temperature is in a range of 45-85° C.

5. The method of claim 1, wherein the temperature is in a range of 55-85° C.

6. The method of claim 1, wherein the temperature is in a range of 65-85° C.

7. The method of claim 1, wherein the decorticated hemp bast skin is pre-treated for up to 5 hours.

8. The method of claim 1, wherein the aqueous solution has a citrate concentration in a range of 0.4-1.6% (w/v).

9. The method of claim 1, wherein the aqueous solution has a citrate concentration of 0.8% (w/v).

10. The method of claim 1, wherein the aqueous solution further contains 0.01-0.5% (w/v) of sodium hydroxide.

11. The method of claim 10, wherein the sodium hydroxide is present in a concentration of 0.04% (w/v).

12. The method of claim 1, wherein the aqueous solution does not contain a strong base.

13. The method of claim 12, further comprising, before treating the recovered fiber with a pectinase, treating the decorticated hemp bast skin with a second aqueous solution containing tri-sodium citrate and a strong base.

14. The method of claim 13, wherein the second aqueous solution has a citrate concentration of 0.8% (w/v) and a pH in a range of 10-13.

15. The method of claim 1, wherein treatment with the pectinase is done in aqueous solution at a pH of 4-6 at 30-45° C.

16. The method of claim 15, wherein treatment with pectinase is done for 0.5-36 hours.

17. The method of claim 15, wherein treatment with pectinase is done for 0.5-6 hours.

18. The method of claim 15, wherein treatment with pectinase is done in presence of monosodium citrate.

* * * * *